US008454148B2

(12) United States Patent
Nakahata et al.

(10) Patent No.: US 8,454,148 B2
(45) Date of Patent: Jun. 4, 2013

(54) LIQUID EJECTION HEAD

(75) Inventors: Kousuke Nakahata, Kawasaki (JP); Hidenori Watanabe, Zama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/176,597

(22) Filed: Jul. 5, 2011

(65) Prior Publication Data

US 2012/0007925 A1 Jan. 12, 2012

(30) Foreign Application Priority Data

Jul. 8, 2010 (JP) ..... 2010-155805

(51) Int. Cl.
*B41J 2/17* (2006.01)
*B41J 2/05* (2006.01)

(52) U.S. Cl.
USPC ..... 347/94; 347/65

(58) Field of Classification Search
None
See application file for complete search history.

(56) References Cited

U.S. PATENT DOCUMENTS 6,250,753 B1 * 6/2001 Nishiwaki et al. ..... 347/94

FOREIGN PATENT DOCUMENTS

JP 7-156403 A 6/1995

* cited by examiner

*Primary Examiner* — Geoffrey Mruk
(74) *Attorney, Agent, or Firm* — Canon USA Inc IP Division

(57) ABSTRACT

A liquid ejection head includes a common liquid chamber for storing liquid, a plurality of flow paths that communicate individually with the common liquid chamber and through which liquid from the common liquid chamber flows, a plurality of ejection orifices that communicate individually with the plurality of flow paths and eject liquid supplied from the common liquid chamber, a plurality of ejection energy generating elements corresponding to the plurality of ejection orifices and generating energy necessary to cause liquid to be ejected from the plurality of ejection orifices, and a movable pressure buffer provided in the common liquid chamber and capable of absorbing a pressure wave generated by driving the plurality of ejection energy generating elements.

5 Claims, 11 Drawing Sheets

LIQUID EJECTION HEAD

BACKGROUND OF THE INVENTION

1. Field of the Invention

The present invention relates to a liquid ejection head having a plurality of nozzles.

2. Description of the Related Art

In a recording apparatus equipped with an on-demand liquid ejection head that ejects ink only during recording, ink is ejected in the form of a droplet from a minute opening for ink ejection (hereinafter referred to as "ejection orifice") provided at one end of each nozzle. At that time, according to the amount of liquid forming the droplet, the meniscus formed in the nozzle moves back. After that, the meniscus is pulled back to the ejection orifice by capillary action. After that, the filled state of the nozzle returns to the state before the ejection. Such a phenomenon is called refill.

In general, in order to increase the recording speed of an on-demand ink jet recording apparatus, the drive frequency is increased, or many nozzles (ejection orifices) are provided in one liquid ejection head. A thermal ink jet recording apparatus, which is one of on-demand ink jet recording apparatuses, has a liquid ejection head that has a simple structure and in which nozzles can be easily arrayed at high density. For this reason, in thermal ink jet recording apparatuses, the recording speed is increased by integrally forming many nozzles.

FIG. 18 is a waveform diagram showing the refill behavior in the case where ink is ejected from a single nozzle and the refill behavior in the case where ink is ejected from many nozzles. In FIG. 18, the horizontal axis shows elapsed time since the ink ejection, and the vertical axis shows the amount of displacement of the meniscus after the ink ejection. On the vertical axis, the position coplanar with the ejection orifice (hereinafter referred to as "ejection orifice plane") is zero (reference). When the amount of displacement is positive, the meniscus is bulging from the ejection orifice plane. When the amount of displacement is negative, the meniscus is displaced from the ejection orifice plane into the nozzle. In FIG. 18, the waveform 101 shows the refill behavior in the case where ink is ejected from a single nozzle, and the waveform 106 shows the refill behavior of a typical nozzle in the case where ink is ejected from many nozzles.

As shown in FIG. 18, after the ink ejection, the meniscus bulges from the ejection orifice plane. After that, the meniscus shows behavior like damped vibration about the ejection orifice plane. In this specification, the time from the ink ejection until the amount of displacement of the meniscus first returns to zero will be referred to as "refill time."

In a thermal liquid ejection head, in the case where ink is ejected from many nozzles at the same time or at a slight interval, the pressure waves of ink generated at the time of bubble formation propagate to a common liquid chamber communicating with each nozzle. For this reason, the sum of the pressures propagating from each nozzle to the common liquid chamber becomes a large force acting in the direction opposite to the direction of refill in each nozzle. As a result, in the case where ink is ejected from many nozzles, the refill time t6 of each nozzle is long compared to the refill time t1 in the case where ink is ejected from a single nozzle. As shown in FIG. 18, in the case where ink is ejected from many nozzles, the amplitude A6 of the meniscus is large compared to the amplitude A1 in the case where ink is ejected from a single nozzle. For this reason, it takes long time before the meniscus returns to a stable state where the amount of displacement of the meniscus is zero. If the next ejection of ink is performed with the meniscus in an unstable state, ejection failure may occur, for example, the amount of liquid forming an ink droplet may change, or the accuracy of the ink ejecting direction may be deteriorated. Such ejection failure may cause a decrease in recording quality due to the change in the diameter of ink dots formed on a recording medium, or blurs, streaks, missing dots, or the like in a recorded image due to a decrease in the landing accuracy of ink droplets onto a recording medium. For this reason, the drive frequency needs to be set within a range where the next ejection is not performed when refill is unstable. As a result, if it takes long time before the meniscus returns to a stable state, it is difficult to increase the drive frequency. Therefore, the increase in the amplitude of the meniscus prevents increasing the number of nozzles.

Japanese Patent Laid-Open No. 7-156403 discloses one of the methods to solve the problems of the long refill time and the large amplitude of the meniscus in the case where ink is ejected from many nozzles. Japanese Patent Laid-Open No. 7-156403 discloses a method including trapping a bubble at an arbitrary position in the common liquid chamber and absorbing the pressure change in the common liquid chamber with the bubble.

In the case where a bubble is used as a pressure buffer like the liquid ejection head described in Japanese Patent Laid-Open No. 7-156403, the capacity C showing the compressibility of a bubble existing in the common liquid chamber is given by the following Equation (1):

$$C = \frac{V_{bub}}{P_{bub}} \qquad \text{Equation (1)}$$

where $V_{bub}$ is the volume of the bubble, and $P_{bub}$ is the pressure of the bubble. The pressure buffering effect of a bubble changes depending on the capacity C.

In the case where a bubble is used as a pressure buffer, it is very difficult to maintain the shape (volume) of the bubble constant for a long time in the common liquid chamber. The volume of the bubble decreases over time, and the capacity C also decreases from the above Equation (1). Therefore, the pressure buffering effect in the common liquid chamber decreases. Therefore, in the case where a bubble is used as a pressure buffer, the pressure buffering effect in the common liquid chamber cannot be maintained, and therefore, it is difficult to stabilize high-speed recording.

SUMMARY OF THE INVENTION

The present invention provides a liquid ejection head capable of stable high-speed recording.

In an aspect of the present invention, a liquid ejection head includes a common liquid chamber for storing liquid, a plurality of flow paths that communicate individually with the common liquid chamber and through which liquid from the common liquid chamber flows, a plurality of ejection orifices that communicate individually with the plurality of flow paths and eject liquid supplied from the common liquid chamber, a plurality of ejection energy generating elements corresponding to the plurality of ejection orifices and generating energy necessary to cause liquid to be ejected from the plurality of ejection orifices, and a movable pressure buffer provided in the common liquid chamber and capable of absorbing a pressure wave generated by driving the plurality of ejection energy generating elements.

Further features of the present invention will become apparent from the following description of exemplary embodiments with reference to the attached drawings.

DESCRIPTION OF THE EMBODIMENTS

Figure 1:
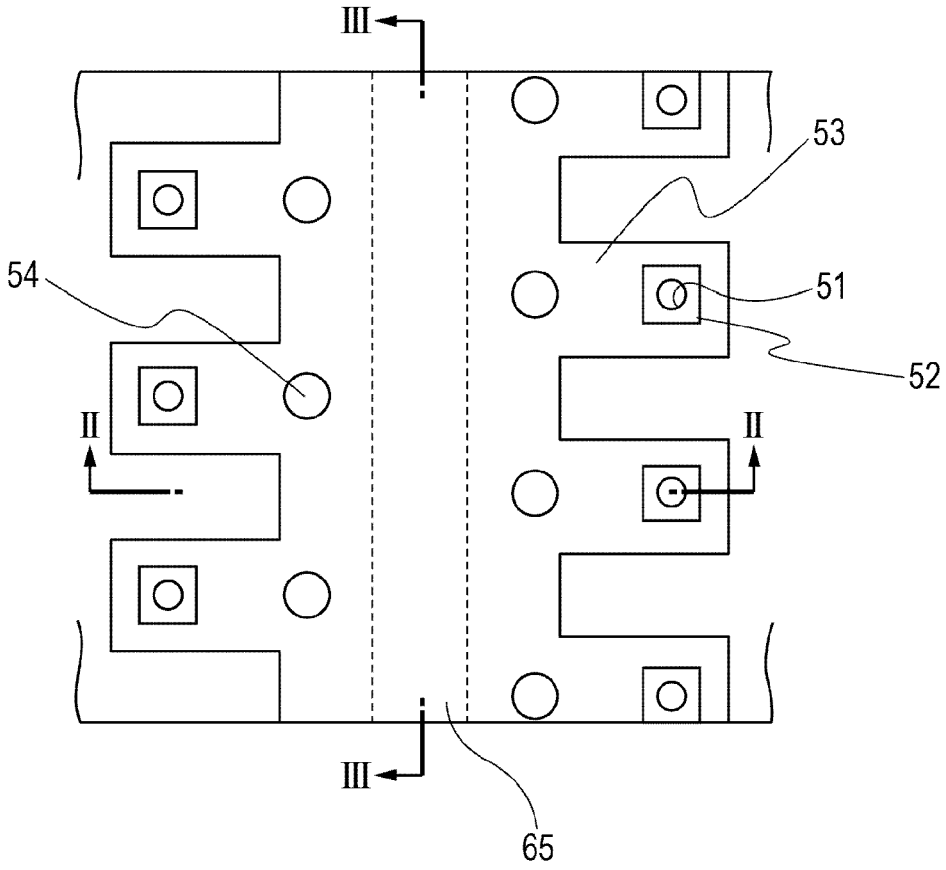
FIG. 1 is a front view of a liquid ejection head of a first embodiment as viewed from the ejection orifice side.
Figure 2:
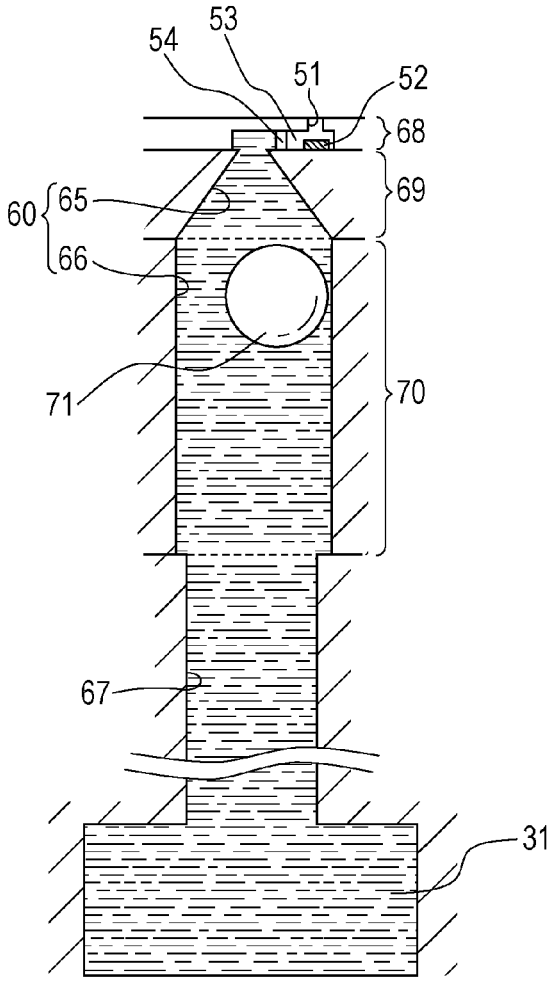
FIG. 2 is a sectional view taken along line II-II of FIG. 1.
Figure 3:
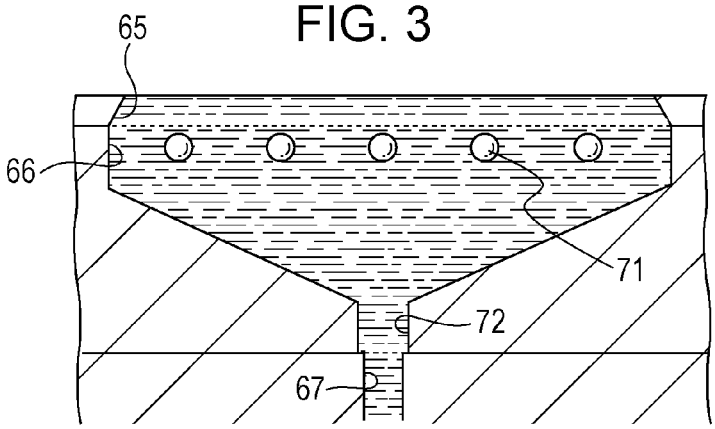
FIG. 3 is a sectional view taken along line III-III of FIG. 1.

FIG. 1 is a front view of a liquid ejection head of a first embodiment as viewed from the ejection orifice side. FIG. 2 is a sectional view taken along line II-II of FIG. 1. FIG. 3 is a sectional view taken along line III-III of FIG. 1.

In the liquid ejection head of this embodiment, ink stored in an ink tank 31 is supplied through an ink supply path 67 to a second common liquid chamber 66 (see FIG. 2). The second common liquid chamber 66 is formed in a third substrate 70. A first common liquid chamber 65 communicating with the second common liquid chamber 66 is formed in a second substrate 69. In this embodiment, the first common liquid chamber 65 and the second common liquid chamber 66 form a common liquid chamber 60 capable of storing ink. A plurality of ink flow paths 53 communicate individually with the first common liquid chamber 65. Each ink flow path 53 is formed in a first substrate 68. After flowing from the first common liquid chamber 65 through a nozzle filter 54 into each ink flow path 53, ink is led to a plurality of ejection orifices 51 communicating individually with the flow paths 53. Each ejection orifice 51 is formed in the first substrate 68. An ejection energy generating element 52 is provided at a position facing the ejection orifice 51 in each ink flow path 53. In this embodiment, the ejection energy generating element 52 is a heat generating element that generates thermal energy as energy necessary to cause ink to be ejected from the ejection orifice 51. When a drive signal is input into the ejection energy generating element 52, the ejection energy generating element 52 generates heat. A bubble is formed in the vicinity of the ejection energy generating element 52, and the pressure of this bubble ejects ink from the ejection orifice 51.

In this embodiment, as shown in FIG. 3, five solid pressure buffers 71 are enclosed in the second common liquid chamber 66. The pressure buffers 71 are capable of absorbing pressure waves of ink propagating from the ink flow paths 53 to the common liquid chamber 60 at the time of ink ejection. The pressure buffers 71 of this embodiment are spherical bodies made of natural rubber and having a diameter of 0.64 mm. The spherical bodies made of natural rubber are manufactured by injection molding. In the liquid ejection head of this embodiment, the first substrate 68, the second substrate 69, and the third substrate 70 are separately formed and bonded together. The pressure buffers 71 are enclosed in the second common liquid chamber 66 in the process of bonding the second substrate 69 and the third substrate 70 together.

The capacity C (coefficient of restoring force) showing the compressibility of the pressure buffers 71 is given by the following Equation (2):

$$C = \frac{\Delta V}{\Delta P} \qquad \text{Equation (2)}$$

where ΔV is volume change, and ΔP is pressure change.

The bulk modulus K of a member that undergoes elastic deformation is given by the following Equation (3):

$$K = V\frac{\Delta P}{\Delta V} \qquad \text{Equation (3)}$$

The bulk modulus K and the shear modulus G are defined by the following Equations (4) and (5), respectively:

$$K = \frac{E}{3} \cdot \frac{G}{3G - E} \qquad \text{Equation (4)}$$

$$G = \frac{E}{2(1 + \gamma)} \qquad \text{Equation (5)}$$

where E is Young's modulus, and γ is Poisson's ratio.

From Equations (2) to (5), the capacity C of the pressure buffers 71 is given by the following Equation (6):

$$C = \frac{3(1 - 2\gamma)V}{E} \qquad \text{Equation (6)}$$

From Equation (6), the capacity C of the pressure buffers 71 can be obtained from the Young's modulus E, Poisson's ratio γ and volume V of the members.

When the pressure buffers 71 of this embodiment each have a diameter of 0.64 mm, a Young's modulus E of 1.5 MPa, and a Poisson's ratio γ of 0.46, the capacity C of each pressure buffer 71 is $2.2\times10^4$ μm/kPa. Since five pressure buffers 71 are enclosed in the second common liquid chamber 66 in this embodiment, the total capacity C of the pressure buffers 71 is $1.1\times10^5$ μm/kPa.

In the liquid ejection head of this embodiment, as shown in FIG. 1, two nozzle arrays (ejection orifice arrays) are formed with the first common liquid chamber 65 therebetween. The number of nozzles of each array is 256, and the total number of nozzles is 512.

Figure 4:
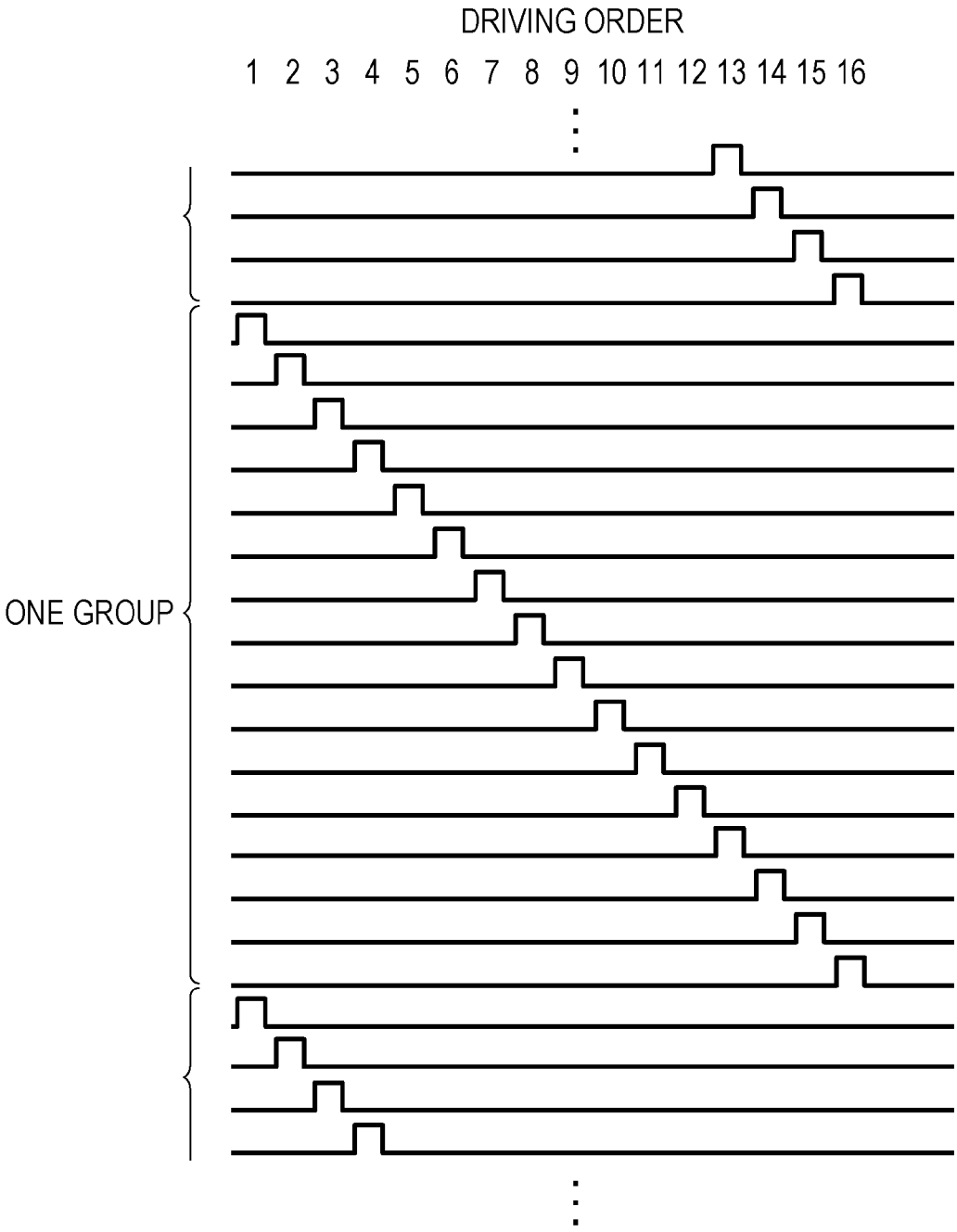
FIG. 4 is a timing chart showing the driving order of ejection energy generating elements.

A description will be given of the measuring result of change in position of the meniscus over time when ink is ejected from all of the 512 nozzles in a liquid ejection head in which the pressure buffers 71 are not enclosed. The pulse width of the drive signal input into each ejection energy generating element 52 is 0.84 μs, and the drive voltage is 24 V. The driving order of each ejection energy generating element 52 is 16 time division sequential drive. FIG. 4 is a timing chart showing the driving order of the ejection energy generating elements 52. In 16 time division sequential drive, 16 nozzles adjacent to each other form one group. When ink has been ejected sequentially from all of the 16 nozzles in the one group, one cycle is completed. A set of nozzles (ejection energy generating elements 52) driven at the same time in each group is called "block." The drive interval between blocks (hereinafter referred to as "block interval") is 2.6 μs. With every 2.6 μs, ink is ejected sequentially from the next block.

Figure 5:
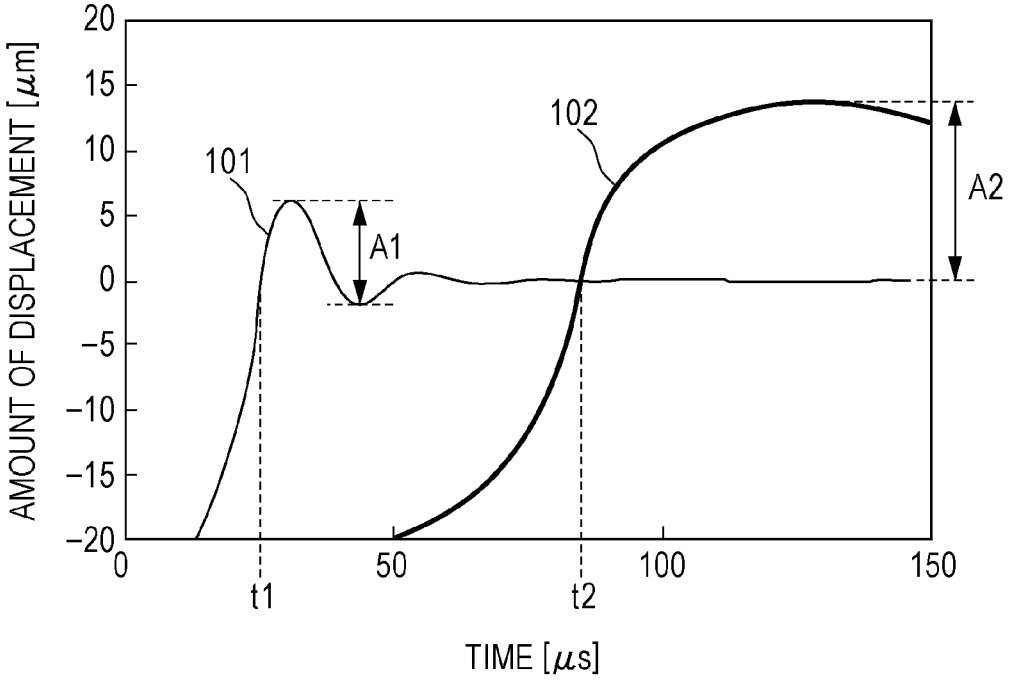
FIG. 5 is a waveform diagram showing the refill behavior of a liquid ejection head in which no pressure buffers are enclosed.
Figure 6:
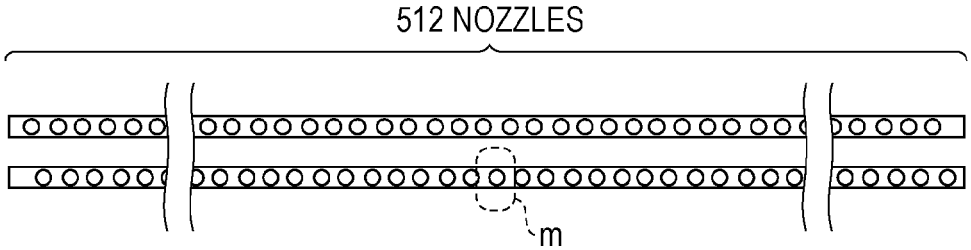
FIG. 6 illustrates the nozzle measured.
Figure 18:
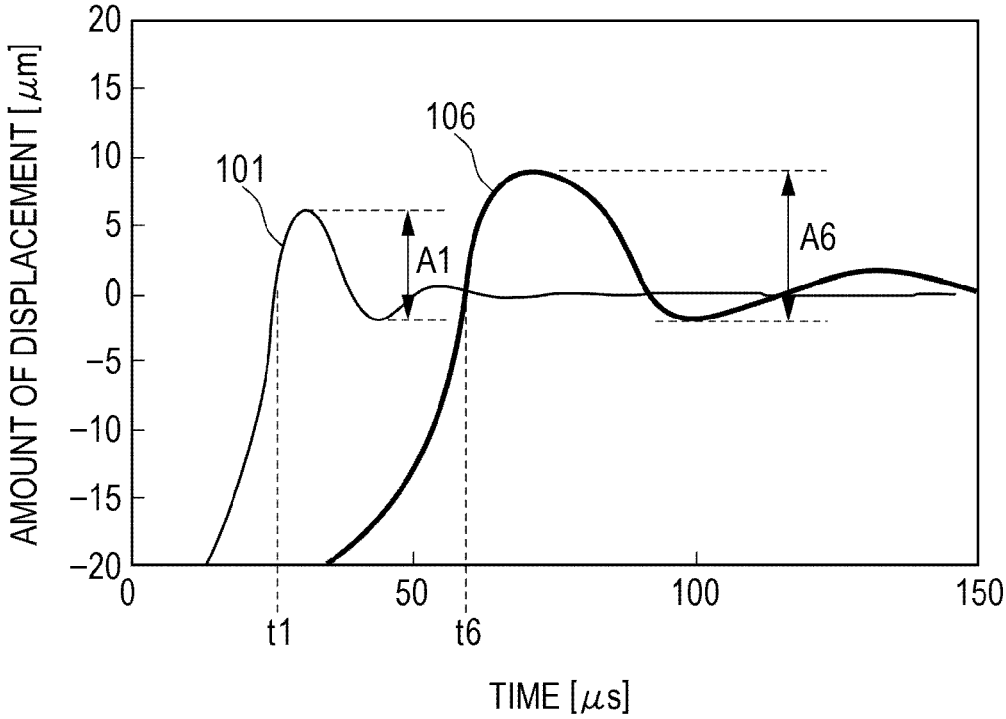
FIG. 18 is a waveform diagram showing the refill behavior in the case where ink is ejected from a single nozzle and the refill behavior in the case where ink is ejected from many nozzles.

FIG. 5 is a waveform diagram showing the refill behavior of a liquid ejection head in which no pressure buffers are enclosed. In FIG. 5, as in FIG. 18, the horizontal axis shows elapsed time since the ink ejection, and the vertical axis shows the amount of displacement of the meniscus after the ink ejection. In this embodiment, the amount of displacement of the meniscus was obtained by measuring the change in velocity of the tip of the meniscus over time with a laser Doppler vibrometer. On the horizontal axis, the time when ejection is just started (the time when the previous ejection of ink is just completed) is 0 μs. As shown in FIG. 6, the nozzle m located nearly in the middle of the nozzle array was measured. In the driving order and the block interval in this embodiment, the block in which the delay in refill is the most noticeable was the twelfth block. So, the nozzle m of the twelfth block was measured. In FIG. 5, not only the waveform 102 showing the refill behavior in the nozzle measured but also the waveform 101 showing the refill behavior in the case where ink is ejected from a single nozzle is shown for comparison.

As shown in FIG. 5, the refill time t1 in the case where ink is ejected from a single nozzle is about 25.5 μs. Driving in such a cycle that this refill time is ensured is the condition for stable ejection, and therefore the acceptable upper limit of the drive frequency is 39.2 kHz.

On the other hand, when ink is ejected from all of the 512 nozzles, the refill time t2 is about 84.9 μs, which is significantly late compared to the case where ink is ejected from a single nozzle. In this case, in order to ensure the refill time, the acceptable upper limit of the drive frequency is 11.8 kHz. That is, when ink is ejected from many nozzles without the pressure buffers 71 enclosed in the second common liquid chamber 66, the acceptable upper limit of the drive frequency is significantly low compared to the case where ink is ejected from a single nozzle. The decrease in drive frequency prevents high-speed recording.

Next, a description will be given of the measuring result of change in position of the meniscus over time when ink is ejected from all of the 512 nozzles in the liquid ejection head of this embodiment in which the pressure buffers 71 are enclosed in the second common liquid chamber 66.

Figure 7:
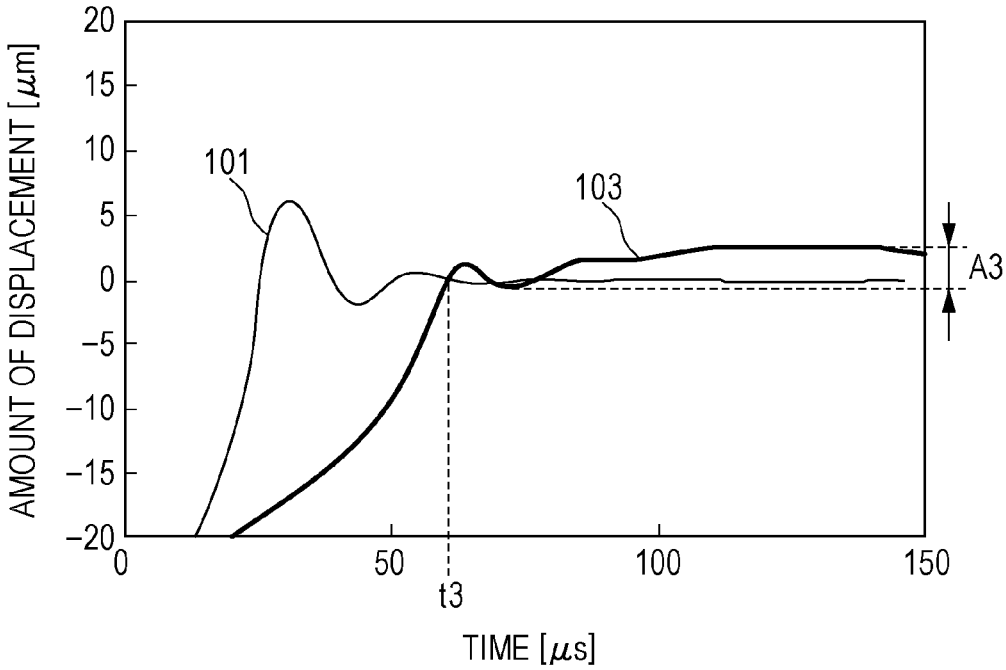
FIG. 7 is a waveform diagram showing the refill behavior of the liquid ejection head of the first embodiment.

FIG. 7 is a waveform diagram showing the refill behavior of the liquid ejection head of this embodiment. In FIG. 7, not only the waveform 103 showing the refill behavior in the nozzle measured but also the waveform 101 showing the refill behavior in the case where ink is ejected from a single nozzle is shown for comparison. The nozzle measured and the drive conditions of the ejection energy generating element 52 are the same as in the above-described case (the case shown in FIG. 5).

As shown in FIG. 7, in the case where the pressure buffers 71 are enclosed in the second common liquid chamber 66, the refill time t3 is also late compared to the case where ink is ejected from a single nozzle. However, compared to the case where no pressure buffers are enclosed in the common liquid chamber (see FIG. 5), the amount of delay of the refill time is significantly reduced. The refill time t3 of the liquid ejection head of this embodiment is about 60.6 μs. In order to ensure this refill time, the acceptable upper limit of the drive frequency is 16.5 kHz. Since the acceptable upper limit of the drive frequency in the case where the pressure buffers 71 are not enclosed is 11.8 kHz, the acceptable upper limit of the drive frequency can be set higher by enclosing the pressure buffers 71 in the second common liquid chamber 66.

As shown in FIG. 7, in the liquid ejection head of this embodiment, the amount of delay of the refill time is reduced, and in addition, the amplitude A3 of the meniscus is small compared to the case where the pressure buffers 71 are not enclosed (see the amplitude A2 of FIG. 5). Even in a nozzle in which refill is completed, if the next ejection of ink is performed when the position of the meniscus is not sufficiently stabilized, the volume of the ejected droplet changes according to the displacement of the meniscus at the time of ejection. For this reason, if the amplitude of the meniscus after the refill time is small, regardless of the time when the next ejection is performed, stable ejection can be performed in which the change of ejection volume is relatively small.

In this embodiment, five rubber spheres having a diameter of 0.64 mm are used as pressure buffers 71, and the capacity C is $1.1\times10^5$ $\mu m^3$/kPa. By regulating the value of the capacity C, the pressure buffering effect can be changed. Specifically, by changing the material, volume, and the number of pressure buffers enclosed, the value of the capacity C can be changed.

Instead of elastic bodies as in this embodiment, porous bodies capable of holding air therein and formed of porous metal, ceramics, resin, or the like may be used as the pressure buffers 71. In this case, the same pressure buffering effect can be obtained.

Next, a description will be given of the measuring result of change in position of the meniscus over time when ink is ejected from all of the 512 nozzles in a liquid ejection head in which instead of the pressure buffers 71, a bubble is injected in the second common liquid chamber 66.

Figure 8:
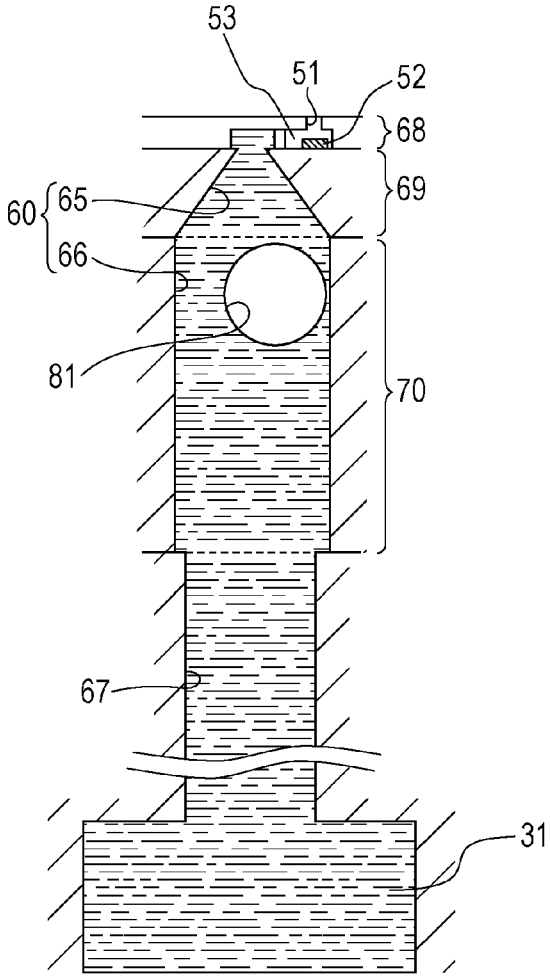
FIG. 8 is a sectional view showing the configuration of the relevant part of a liquid ejection head in which a bubble is injected in the common liquid chamber.
Figure 9:
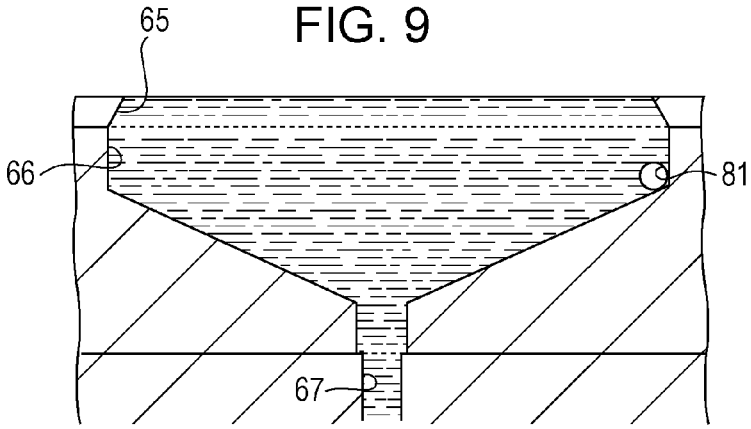
FIG. 9 is a sectional view showing the configuration of the relevant part of a liquid ejection head in which a bubble is injected in the common liquid chamber.

FIGS. 8 and 9 are sectional views showing the configuration of the relevant part of a liquid ejection head in which a bubble is injected in the common liquid chamber. FIG. 8 shows the same section as FIG. 2, and FIG. 9 shows the same section as FIG. 3. In the liquid ejection head shown in FIGS. 8 and 9, a bubble 81 having a diameter of about 0.6 mm is injected in the second common liquid chamber 66. The capacity C of the bubble 81 having a diameter of about 0.6 mm is $1.1\times10^6$ $\mu m^3$/kPa from Equation (1), assuming that the bubble 81 is spherical.

Figure 10:
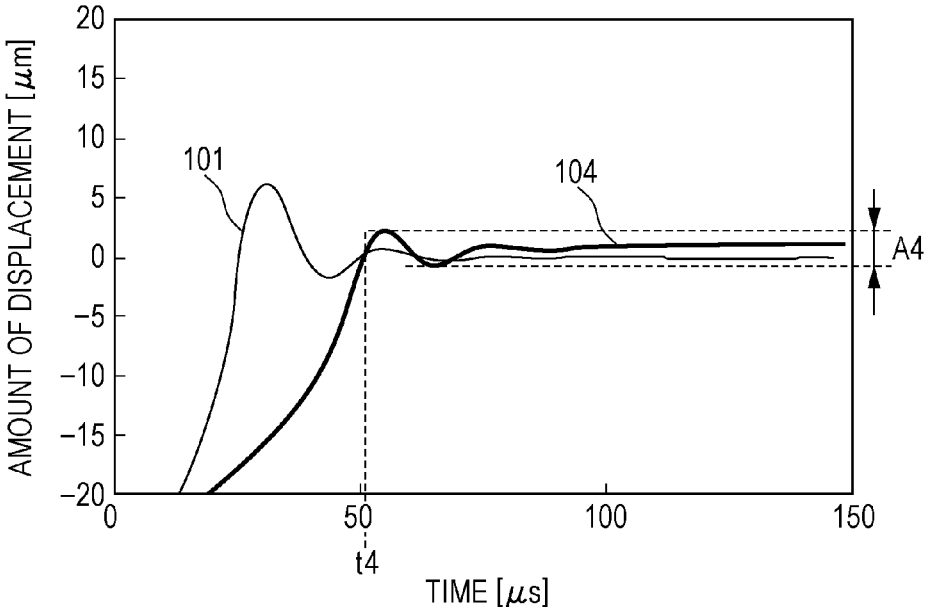
FIG. 10 is a waveform diagram showing the refill behavior of the liquid ejection head shown in FIGS. 8 and 9.

FIG. 10 is a waveform diagram showing the refill behavior of the liquid ejection head shown in FIGS. 8 and 9. In FIG. 10, not only the waveform 104 showing the refill behavior in the nozzle measured but also the waveform 101 showing the refill behavior in the case where ink is ejected from a single nozzle is shown for comparison. The nozzle measured and the drive conditions of the ejection energy generating element 52 are the same as in the above-described two cases (the cases shown in FIGS. 5 and 7).

As shown in FIG. 10, in the case where a bubble 81 is injected as a pressure buffer, the refill time t4 is also late compared to the case where ink is ejected from a single nozzle. However, compared to the case where the pressure buffers 71 are not enclosed in the common liquid chamber (see FIG. 5), the amount of delay of the refill time is significantly reduced. In addition, the amplitude A4 of the meniscus is small compared to the case where the pressure buffers 71 are not enclosed (see the amplitude A2 of FIG. 5). In the liquid ejection head shown in FIGS. 8 and 9, the refill time t4 is about 51.0 μs. In order to ensure this refill time, the acceptable upper limit of the drive frequency is 19.6 kHz. As described above, in the case where a bubble is used as a pressure buffer, a great pressure buffering effect can also be obtained. Compared to a rubber sphere (pressure buffer 71) having the same volume, the bubble 81 has a greater pressure buffering effect. The reason is that the capacity C of five rubber spheres each having a diameter of about 0.64 μm is $1.1\times10^5$ $\mu m^3$/kPa, whereas the capacity C of a bubble having almost the same volume is $1.1\times10^6$ μm/kPa, which is ten times the capacity C of the five rubber spheres.

However, when a bubble 81 is used as a pressure buffer, it is very difficult to keep the shape (volume) of the bubble 81 constant for a long time in the second common liquid chamber 66. With the decrease of the volume of the bubble 81, the capacity C decreases from the above Equation (1). It is unlikely that a constant pressure buffering effect can be obtained for a long time in the second common liquid chamber 66. In contrast, in the case where rubber spheres are used as pressure buffers 71 like the liquid ejection head of this embodiment, the volume can be maintained constant for a long time. For this reason, the capacity C does not easily change. As a result, a stable pressure buffering effect can be obtained. As described above, using elastic bodies as pressure buffers is very advantageous in terms of durability and stability of effect compared to using a bubble as a pressure buffer. In the case where elastic bodies are used as pressure buffers, a greater pressure buffering effect can be obtained by increasing the number of elastic bodies or increasing the volume of the elastic bodies.

Next, a description will be given of the measuring result of change in position of the meniscus over time when ink is ejected from all of the 512 nozzles in a liquid ejection head in which pressure buffers 71 are enclosed not in the second common liquid chamber 66 but in the ink supply path 67.

Figure 11:
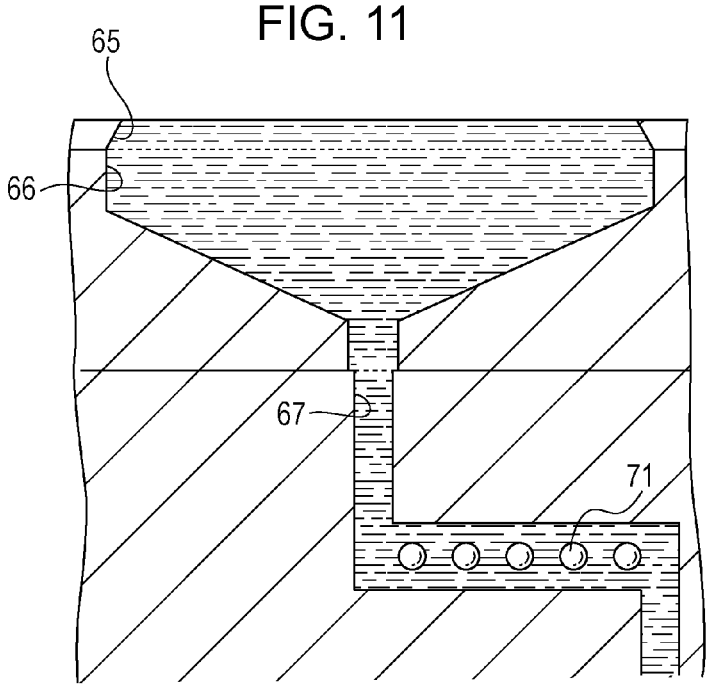
FIG. 11 is a sectional view showing the configuration of the relevant part of a liquid ejection head in which pressure buffers are enclosed in the ink supply path.

FIG. 11 is a sectional view showing the configuration of the relevant part of a liquid ejection head in which pressure buffers are enclosed in the ink supply path. In the liquid ejection head shown in FIG. 11, five pressure buffers 71 are enclosed in the ink supply path 67 as shown in FIG. 11. Each pressure buffer 71 is a rubber sphere having a diameter of 0.64 mm. The total capacity C of the five rubber spheres is $1.1\times10^5$ $\mu m^3$/kPa, which is the same as that of the liquid ejection head of this embodiment.

Figure 12:
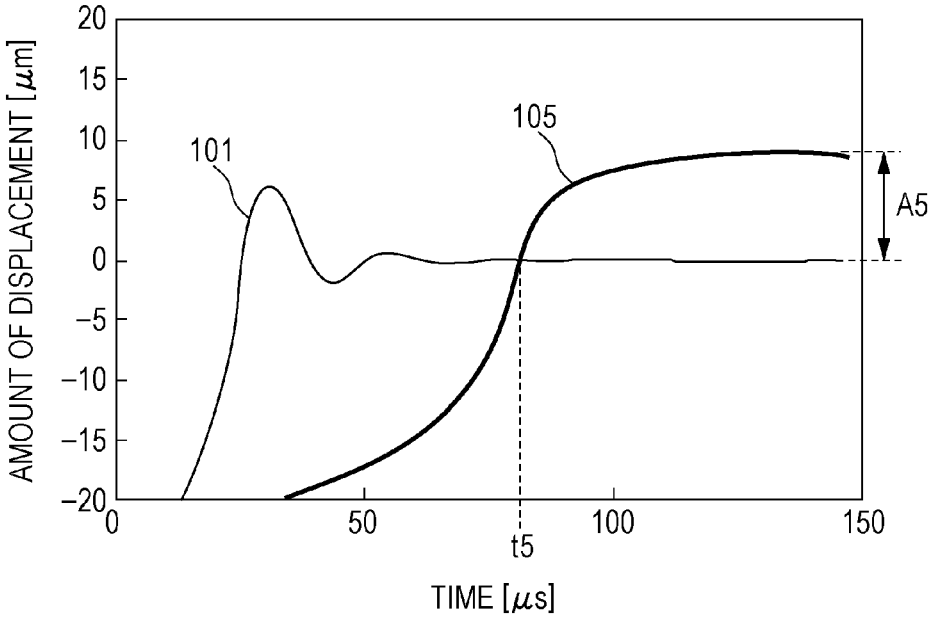
FIG. 12 is a waveform diagram showing the refill behavior of the liquid ejection head shown in FIG. 11.

FIG. 12 is a waveform diagram showing the refill behavior of the liquid ejection head shown in FIG. 11. As shown in FIG. 12, the amplitude A5 of the meniscus is slightly small compared to the meniscus amplitude A2 (see FIG. 5) of a liquid ejection head in which no pressure buffers are enclosed. The refill time t5 is about 82.2 μs. In order to ensure this refill time, the acceptable upper limit of the drive frequency is 12.2 kHz. The acceptable upper limit of the drive frequency in the case where the pressure buffers 71 are not enclosed is 11.8 kHz. Enclosing the pressure buffers 71 in the ink supply path 67 improves the amount of delay of the refill time very little. Therefore, in order to obtain a greater pressure buffering effect, the pressure buffers 71 can exist in the second common liquid chamber 66 as in the first embodiment.

Figure 13:
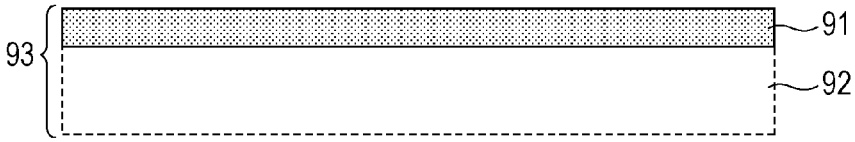
FIG. 13 shows an example of a printing pattern in which printing is performed only in a part of a printable area.
Figure 14:
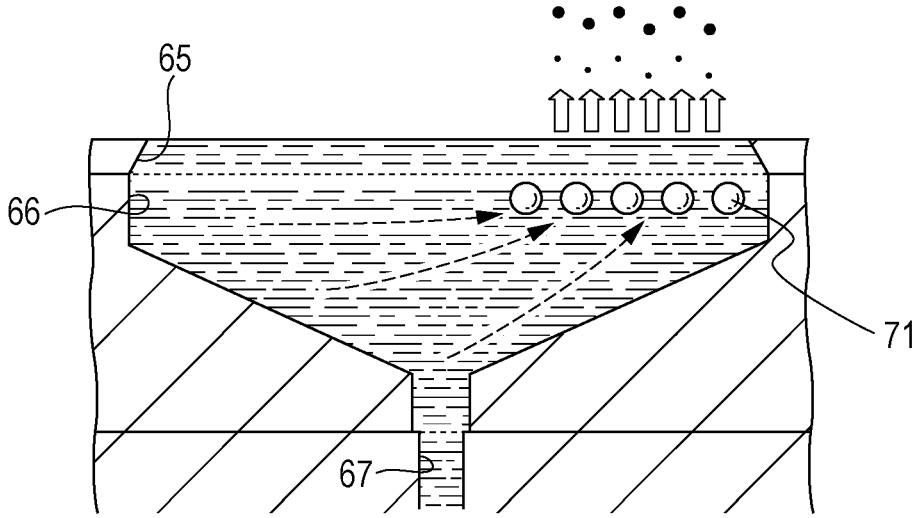
FIG. 14 shows pressure buffers moving with the flow of ink.

In the case where printing is performed using only part of the nozzle array as shown in FIG. 13, depending on the size, specific gravity, or the like of the pressure buffers 71, the pressure buffers 71 follow the flow of ink in the second common liquid chamber 66 and move in the direction of nozzles that eject ink (see FIG. 14). In FIG. 13, printing is performed only in the upper part (printing area 91) of a printable area 93, and printing is not performed in the part (non-printing area 92) below the printing area 91.

A liquid ejection head of a second embodiment will be described. The same reference numerals will be used to designate the same components as those in the first embodiment, and the detailed description thereof will be omitted.

The pressure buffers 71 described in the first embodiment are spherical. For this reason, depending on the weight or size thereof, the pressure buffers 71 may block a part (communicating part 72, see FIG. 3) of the second common liquid chamber 66 communicating with the ink supply path 67. In this case, the ink supply from the ink tank 31 is blocked, and ejection failure may be caused. In addition, the pressure buffers 71 may move from the second common liquid chamber 66 through the ink supply path 67 to the ink tank 31. In this case, as described in the first embodiment, the outflow of the pressure buffers 71 from the second common liquid chamber 66 may reduce the pressure buffering effect.

Figure 15:
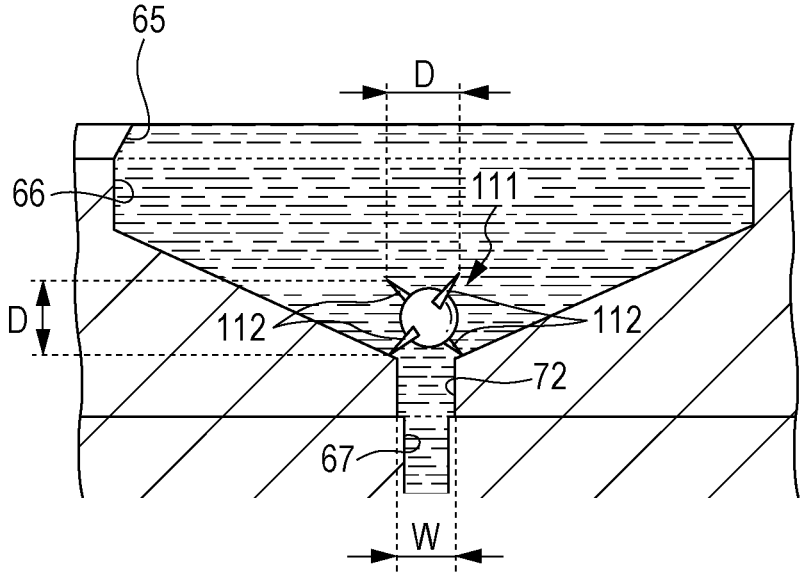
FIG. 15 is a sectional view showing the configuration of the relevant part of a liquid ejection head of a second embodiment.

So, in this embodiment, as shown in FIG. 15, a pressure buffer 111 having a plurality of protrusions 112 formed on the surface thereof is enclosed in the second common liquid chamber 66. In the pressure buffer 111, the distance D between the tips of the protrusions 112 is larger than the width W of the communicating part 72 of the second common liquid chamber 66 (see FIG. 15). When the pressure buffer 111 moves to the communicating part 72, a gap is formed between the communicating part 72 and the pressure buffer 111 by the protrusions 112. Therefore, the ink supply from the ink tank 31 can be prevented from being blocked. In addition, the pressure buffer 111 can be prevented from moving from the second common liquid chamber 66 to the ink supply path 67. The pressure buffer 111 can be formed of a versatile material such as rubber, and therefore even if it has a complicated shape, it can be formed by injection molding.

Figure 16:
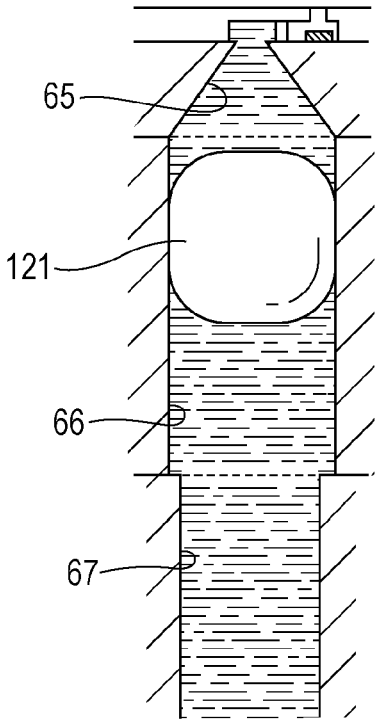
FIG. 16 is a sectional view showing another shape of the pressure buffer.
Figure 17:
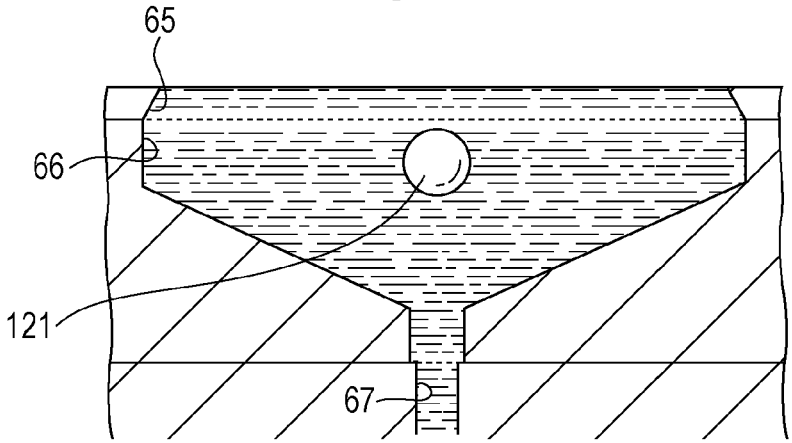
FIG. 17 is a sectional view showing another shape of the pressure buffer.

FIGS. 16 and 17 are sectional views showing another shape of the pressure buffer. In order to prevent the pressure buffer from blocking the ink supply and reducing the pressure buffering effect, the pressure buffer 121 shown in FIGS. 16 and 17 may be used. The pressure buffer 121 is a spherical body having a diameter slightly larger than the width of the narrowest part of the second common liquid chamber 66. By squeezing the pressure buffer 121 into the second common liquid chamber 66, the pressure buffer 121 is fixed to a part of the second common liquid chamber 66. Thus, the pressure buffer 121 can be prevented from blocking the communicating part 72 of the second common liquid chamber 66 or flowing into the ink supply path 67.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-155805 filed Jul. 8, 2010, which is hereby incorporated by reference herein in its entirety.

What is claimed is:

1. A liquid ejection head comprising:

a common liquid chamber for storing liquid;

a plurality of flow paths that communicate individually with the common liquid chamber and through which liquid from the common liquid chamber flows;

a plurality of ejection orifices that communicate individually with the plurality of flow paths and eject liquid supplied from the common liquid chamber;

a plurality of ejection energy generating elements corresponding to the plurality of ejection orifices and generating energy necessary to cause liquid to be ejected from the plurality of ejection orifices; and a movable pressure buffer member moveable in liquid in the common liquid chamber provided in the common liquid chamber and capable of absorbing a pressure wave generated by driving the plurality of ejection energy generating elements.

2. The liquid ejection head according to claim 1, wherein the pressure buffer is an elastic body.

3. The liquid ejection head according to claim 1, wherein the pressure buffer is a porous body capable of holding air therein.

4. The liquid ejection head according to claim 1, wherein a plurality of protrusions are formed on the surface of the pressure buffer.

5. The liquid ejection head according to claim 4, wherein a distance between the tips of the plurality of protrusions is greater than an opening diameter of a communicating part.

* * * * *